US010401766B2

(12) United States Patent
Sugiyama et al.

(10) Patent No.: US 10,401,766 B2
(45) Date of Patent: Sep. 3, 2019

(54) IMAGE FORMING APPARATUS AND IMAGE FORMING METHOD WITH TEMPERATURE AND POWER-BASED PRODUCTIVITY RATE SELECTION

(71) Applicants: Ryohhei Sugiyama, Kanagawa (JP); Hiroshi Ono, Tokyo (JP); Hironori Yamaoka, Kanagawa (JP); Motoyoshi Yamano, Kanagawa (JP); Yoshikuni Sasaki, Kanagawa (JP); Tetsuo Tokuda, Tokyo (JP)

(72) Inventors: Ryohhei Sugiyama, Kanagawa (JP); Hiroshi Ono, Tokyo (JP); Hironori Yamaoka, Kanagawa (JP); Motoyoshi Yamano, Kanagawa (JP); Yoshikuni Sasaki, Kanagawa (JP); Tetsuo Tokuda, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 166 days.

(21) Appl. No.: 15/293,881

(22) Filed: Oct. 14, 2016

(65) Prior Publication Data

US 2017/0131666 A1 May 11, 2017

(30) Foreign Application Priority Data

Nov. 10, 2015 (JP) ..... 2015-220218
Jan. 15, 2016 (JP) ..... 2016-005961

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS 5,289,247 A * 2/1994 Takano ..... G03G 15/2042 399/45
6,393,233 B1 * 5/2002 Soulier ..... G03G 15/2003 219/216

(Continued)

FOREIGN PATENT DOCUMENTS

JP 54-080135 6/1979
JP 10-177313 6/1998

(Continued)

OTHER PUBLICATIONS

U.S. Appl. No. 15/202,878, filed Jul. 6, 2016.

*Primary Examiner* — Benjamin R Schmitt
*Assistant Examiner* — Milton Gonzalez
(74) *Attorney, Agent, or Firm* — Harness, Dickey & Pierce, P.L.C.

(57) ABSTRACT

An image forming apparatus includes a fixing rotator rotatable in a predetermined direction of rotation, over which a recording medium is conveyed, and a heater to heat the fixing rotator. A temperature detector detects a temperature of the fixing rotator. A controller performs a primary productivity control to define a primary productivity rate of printing per unit time based on the temperature of the fixing rotator that is detected by the temperature detector. The controller calculates an amount of power suppliable to the heater and performs a secondary productivity control simultaneously with and separately from the primary productivity control. The secondary productivity control defines a secondary productivity rate of printing per unit time based on the amount of power suppliable to the heater. The controller selects one of the primary productivity rate and the secondary productivity rate whichever is lower as a productivity rate of the image forming apparatus.

24 Claims, 9 Drawing Sheets

(56) References Cited

U.S. PATENT DOCUMENTS

| | | | | |
|---|---|---|---|---|
| 6,591,073 | B1 * | 7/2003 | Fujii | B41J 29/393 399/88 |
| 2007/0071479 | A1 | 3/2007 | Semma et al. | |
| 2014/0219672 | A1 | 8/2014 | Samei et al. | |
| 2014/0219673 | A1 | 8/2014 | Yamamoto et al. | |
| 2014/0376938 | A1 | 12/2014 | Yamaoka et al. | |
| 2015/0261155 | A1 | 9/2015 | Yoshiura et al. | |

FOREIGN PATENT DOCUMENTS

| | | |
|---|---|---|
| JP | 2007-108718 | 4/2007 |
| JP | 2010-156770 | 7/2010 |

* cited by examiner

| | | PAPER TYPE | | | |
|---|---|---|---|---|---|
| | | THIN PAPER | PLAIN PAPER | MEDIUM PAPER | THICK PAPER |
| AMBIENT TEMPERATURE | 10°C OR LOWER | 80% | 80% | 65% | 50% |
| | HIGHER THAN 10°C AND LOWER THAN 23°C | 100% | 80% | 65% | 50% |
| | 23°C OR HIGHER | 100% | 100% | 80% | 65% |

IMAGE FORMING APPARATUS AND IMAGE FORMING METHOD WITH TEMPERATURE AND POWER-BASED PRODUCTIVITY RATE SELECTION

CROSS-REFERENCE TO RELATED APPLICATIONS

This patent application is based on and claims priority pursuant to 35 U.S.C. § 119 to Japanese Patent Application Nos. 2015-220218, filed on Nov. 10, 2015, and 2016-005961, filed on Jan. 15, 2016, in the Japanese Patent Office, the entire disclosure of each of which is hereby incorporated by reference herein.

BACKGROUND

Technical Field

Exemplary embodiments generally relate to an image forming apparatus and an image forming method, and more particularly, to an image forming apparatus for forming a toner image on a recording medium and an image forming method performed by the image forming apparatus.

Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller and a fixing belt, and a heater that heats the fixing rotator to a fixing temperature at which the fixing rotator melts and fixes the toner image on the recording medium. However, while the recording medium is conveyed over the fixing rotator, the recording medium draws heat from the fixing rotator, decreasing a temperature of the fixing rotator. Accordingly, the fixing rotator may suffer from shortage of heat.

SUMMARY

This specification describes below an improved image forming apparatus. In one exemplary embodiment, the image forming apparatus includes a fixing rotator rotatable in a predetermined direction of rotation, over which a recording medium is conveyed, and a heater to heat the fixing rotator. A temperature detector detects a temperature of the fixing rotator. A controller performs a primary productivity control to define a primary productivity rate of printing per unit time based on the temperature of the fixing rotator that is detected by the temperature detector. The controller calculates an amount of power suppliable to the heater and performs a secondary productivity control simultaneously with and separately from the primary productivity control. The secondary productivity control defines a secondary productivity rate of printing per unit time based on the amount of power suppliable to the heater. The controller selects one of the primary productivity rate and the secondary productivity rate whichever is lower as a productivity rate of the image forming apparatus.

This specification further describes below an improved image forming method. In one exemplary embodiment, the image forming method includes starting a print job; determining that a first predetermined time has elapsed after starting the print job; determining to start a primary productivity control; determining to degrade a primary productivity rate; determining that the degraded primary productivity rate is not a lower limit; degrading the primary productivity rate by one grade; and determining that a second predetermined time has elapsed after degrading the primary productivity rate by one grade.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
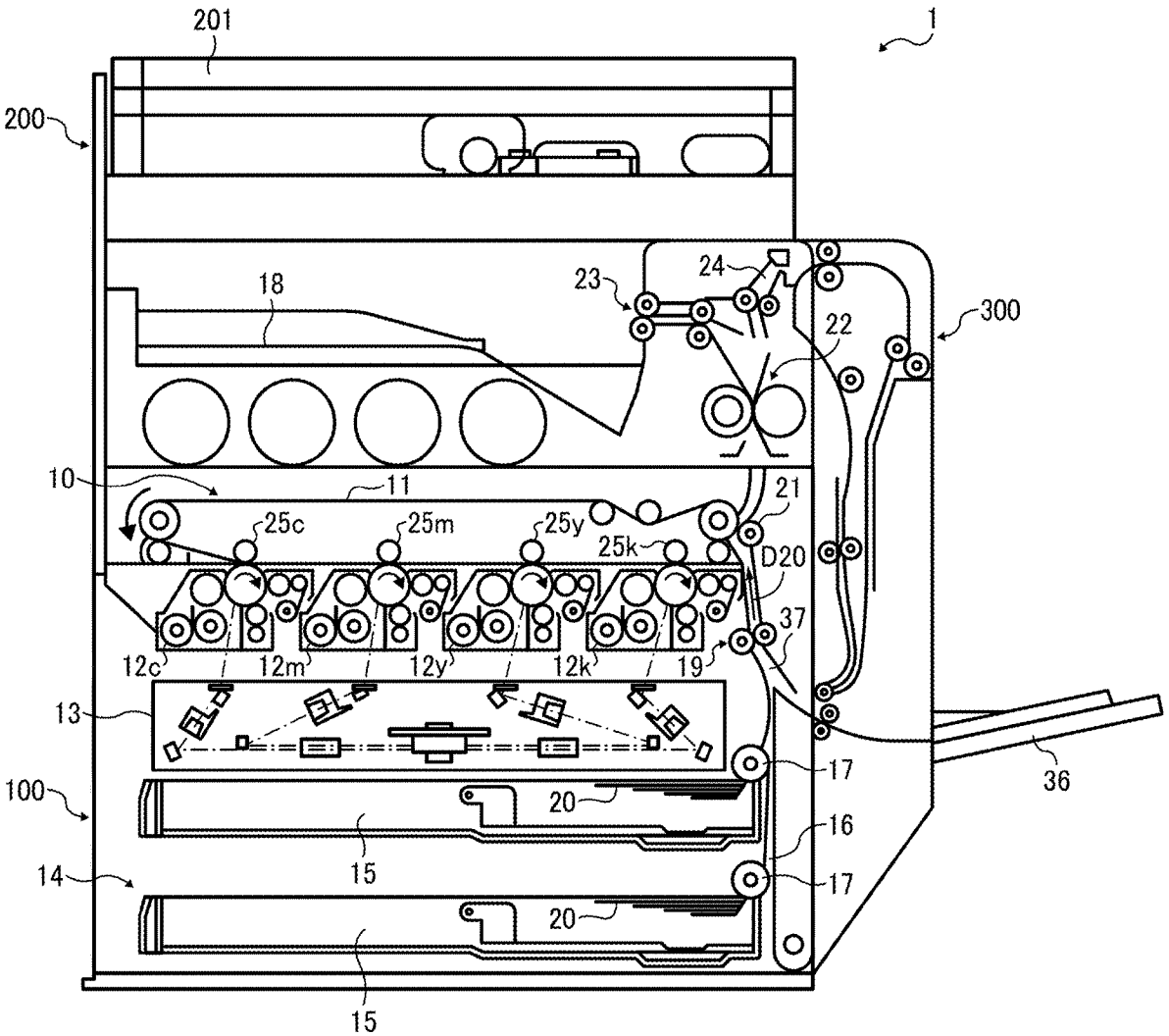
FIG. 1 is a schematic vertical cross-sectional view of an image forming apparatus according to an exemplary embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1 according to an exemplary embodiment is explained.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color copier that forms color and monochrome toner images on recording media by electrophotography. Alternatively, the image forming apparatus 1 may be a monochrome copier that forms a monochrome toner image.

Referring to FIG. 1, a description is provided of a construction of the image forming apparatus 1.

FIG. 1 illustrates an interior of the image forming apparatus 1. The image forming apparatus 1 forms a color toner image on a recording medium by electrophotography. The image forming apparatus 1 includes a body 100, an image scanner 200 disposed atop the body 100, and a duplex unit 300 attached to a right side face in FIG. 1 of the body 100. The image scanner 200 includes an auto document feeder (ADF) 201. An intermediate transfer device 10 is situated inside the body 100. The intermediate transfer device 10 includes an endless intermediate transfer belt 11 that is looped over a plurality of rollers and rotatable counterclockwise in FIG. 1. The intermediate transfer belt 11 extends substantially horizontally.

Below the intermediate transfer device 10 are four image forming devices 12*c*, 12*m*, 12*y*, and 12*k* that form cyan, magenta, yellow, and black toner images, respectively. The image forming devices 12*c*, 12*m*, 12*y*, and 12*k* are aligned along a lower face of the intermediate transfer belt 11, constructing a four-consecutive tandem structure. Each of the image forming devices 12*c*, 12*m*, 12*y*, and 12*k* includes a photoconductive drum serving as an image bearer being rotatable clockwise in FIG. 1 and surrounded by a charger, a developing device, a primary transfer device (e.g., primary transfer devices 25*c*, 25*m*, 25*y*, and 25*k*), a cleaner, and the like. Below the image forming devices 12*c*, 12*m*, 12*y*, and 12*k* is an exposure device 13.

Below the exposure device 13 is a sheet feeder 14. The sheet feeder 14 includes two paper trays 15 layered vertically. Each of the paper trays 15 loads a plurality of sheets 20 serving as recording media. Downstream from each of the paper trays 15 in a sheet conveyance direction D20 is a feed roller 17 that picks up and feeds an uppermost sheet 20 of the plurality of sheets 20 loaded on the paper tray 15 to a sheet conveyance path 16.

The sheet conveyance path 16 extends vertically inside a right part of the body 100 to convey the sheet 20 upward in FIG. 1. The sheet conveyance path 16 communicates with an internal output tray 18 disposed atop the body 100 and below the image scanner 200. The sheet conveyance path 16 is provided with a conveyance roller pair 19, a secondary transfer device 21, a fixing device 22, an output device 23, and the like arranged in this order in the sheet conveyance direction D20. The secondary transfer device 21 is disposed opposite the intermediate transfer belt 11. The output device 23 includes a pair of output rollers. Immediately upstream from the conveyance roller pair 19 in the sheet conveyance direction D20 is a sheet feeding path 37 that adjoins the sheet conveyance path 16 to deliver the sheet 20 conveyed from the duplex unit 300 or a sheet 20 conveyed from a bypass tray 36 across the duplex unit 300. Downstream from the fixing device 22 in the sheet conveyance direction D20 is a refeed path 24 that branches from the sheet conveyance path 16 to convey the sheet 20 to the duplex unit 300.

As the image forming apparatus 1 receives a copy job, the image scanner 200 reads an image on an original and the exposure device 13 writes electrostatic latent images on the photoconductive drums of the image forming devices 12*c*, 12*m*, 12*y*, and 12*k*, respectively. The developing devices of the image forming devices 12*c*, 12*m*, 12*y*, and 12*k* visualize the electrostatic latent images into cyan, magenta, yellow, and black toner images, respectively. The primary transfer devices 25*c*, 25*m*, 25*y*, and 25*k* primarily transfer the cyan, magenta, yellow, and black toner images formed on the photoconductive drums onto the intermediate transfer belt 11 successively, such that the cyan, magenta, yellow, and black toner images are superimposed on a same position on the intermediate transfer belt 11, thus forming a color toner image on the intermediate transfer belt 11.

On the other hand, one of the feed rollers 17 is selectively rotated to feed a sheet 20 from the corresponding paper tray 15 to the sheet conveyance path 16. Alternatively, a sheet 20 may be conveyed from the bypass tray 36 to the sheet feeding path 37. The conveyance roller pair 19 feeds the sheet 20 through the sheet conveyance path 16 to a secondary transfer nip formed between the intermediate transfer belt 11 and the secondary transfer device 21 at a time when the color toner image formed on the intermediate transfer belt 11 reaches the secondary transfer nip. As the sheet 20 is conveyed through the secondary transfer nip, the secondary transfer device 21 secondarily transfers the color toner image formed on the intermediate transfer belt 11 onto the sheet 20. The sheet 20 bearing the color toner image is conveyed to the fixing device 22 that fixes the color toner image on the sheet 20 under heat and pressure. Thereafter, the output device 23 ejects the sheet 20 bearing the fixed color toner image onto the internal output tray 18 that stacks the sheet 20.

If the copy job requests duplex copy to form another toner image on a back side of the sheet 20, the sheet 20 enters the refeed path 24 that guides the sheet 20 to the duplex unit 300. The duplex unit 300 reverses the sheet 20 and conveys the sheet 20 to the sheet feeding path 37 that refeeds the sheet 20 to the secondary transfer nip. As the sheet 20 is conveyed through the secondary transfer nip, the secondary transfer device 21 secondarily transfers another color toner image formed on the intermediate transfer belt 11 onto the back side of the sheet 20. The sheet 20 bearing the color toner image is conveyed to the fixing device 22 again where the color toner image is fixed on the back side of the sheet 20 under heat and pressure. Thereafter, the output device 23 ejects the sheet 20 bearing the fixed color toner image onto the internal output tray 18.

A description is provided of a construction of the fixing device 22 incorporated in the image forming apparatus 1 having the construction described above.

Figure 2:
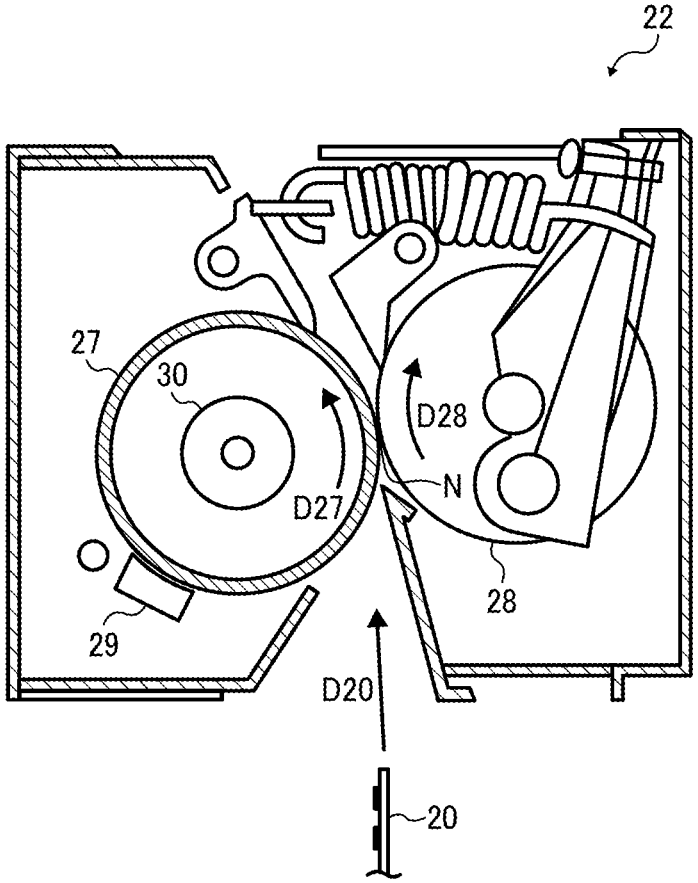
FIG. 2 is a partial vertical cross-sectional view of a fixing device incorporated in the image forming apparatus depicted in FIG. 1.

FIG. 2 is a partial vertical cross-sectional view of the fixing device 22. As illustrated in FIG. 2, the fixing device 22 (e.g., a fuser or a fusing unit) includes a fixing roller 27 serving as a fixing rotator or a fixing member rotatable in a rotation direction D27, a heater 30 serving as a heater or a heat source that heats the fixing roller 27, and a pressure roller 28 serving as a pressure rotator rotatable in a rotation direction D28. The pressure roller 28 is pressed against the fixing roller 27 to form a fixing nip N therebetween. A temperature sensor 29 is disposed opposite an outer circumferential surface of the fixing roller 27. The temperature sensor 29 serves as a temperature detector that detects a temperature of the outer circumferential surface of the fixing roller 27. The temperature sensor 29 detects whether or not the temperature of the fixing roller 27 reaches a fixing temperature at which a toner image is fixed on the sheet 20. The heater 30 (e.g., a halogen heater or a nichrome wire infrared heater) is disposed inside the fixing roller 27. The heater 30 heats the fixing roller 27. The heater 30 is controlled based on the temperature of the fixing roller 27 that is detected by the temperature sensor 29 so that the temperature of the outer circumferential surface of the fixing roller 27 is constant.

A shaft of the fixing roller 27 is rotatably secured to side plates. Conversely, a shaft of the pressure roller 28 is movable relative to the fixing roller 27. The pressure roller 28 is supported such that the pressure roller 28 comes into contact with and separates from the fixing roller 27. A spring biases and presses the pressure roller 28 against the fixing roller 27. Alternatively, a fixing belt may be employed instead of the fixing roller 27 and a pressure belt may be employed instead of the pressure roller 28.

In the fixing device 22, the heater 30 heats the fixing roller 27. As the fixing roller 27 heated by the heater 30 comes into contact with an imaged side of the sheet 20 that bears the toner image while the sheet 20 is conveyed through the fixing nip N in the sheet conveyance direction D20, the fixing roller 27 melts the toner image on the imaged side of the sheet 20, thus fixing the toner image on the sheet 20.

A description is provided of a configuration of an electric system of the image forming apparatus 1.

Figure 3:
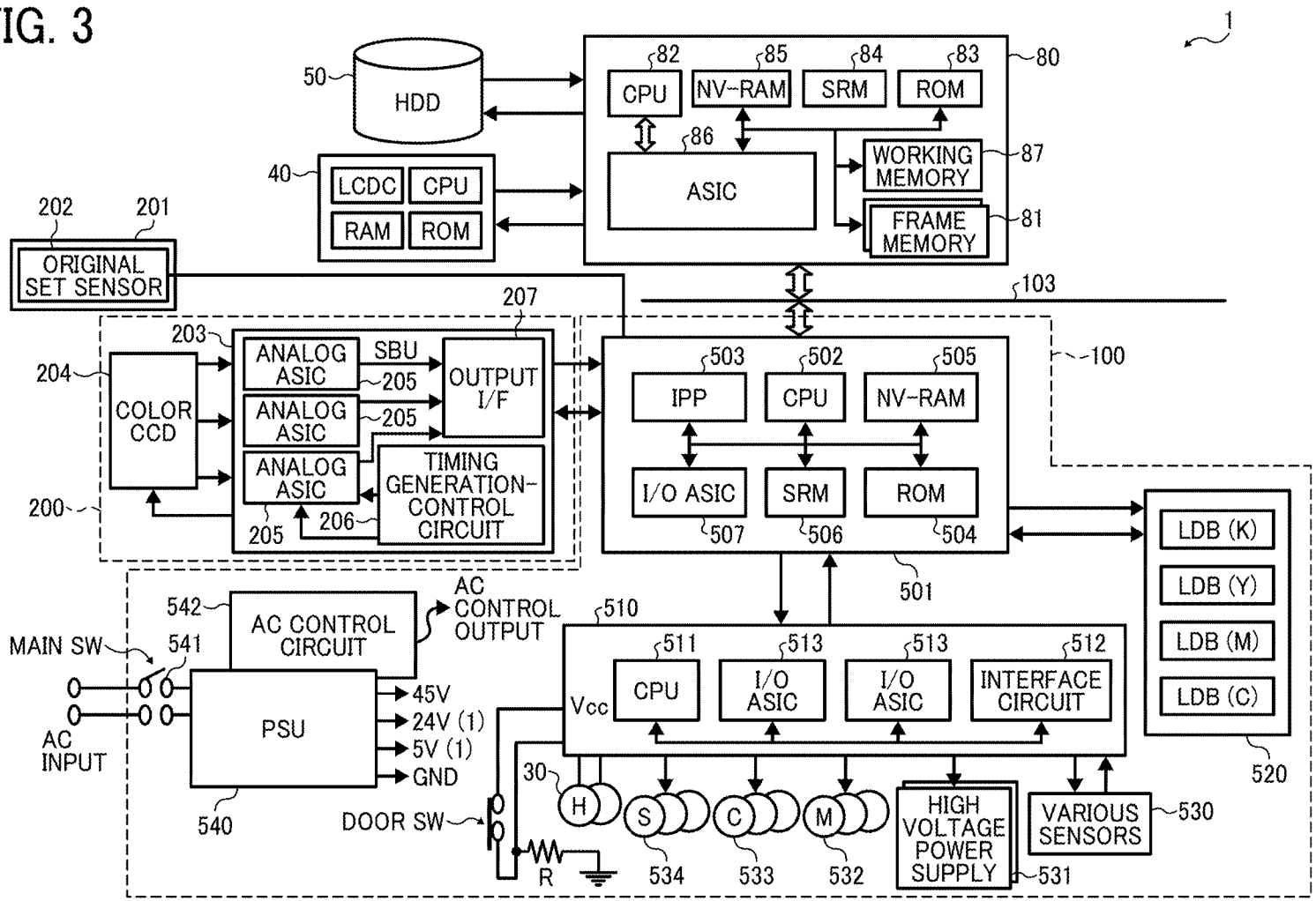
FIG. 3 is a block diagram of an electric system of the image forming apparatus depicted in FIG. 1.

FIG. 3 is a block diagram of the electric system of a main part of the image forming apparatus 1. The electric system of the image forming apparatus 1 includes a controller board 80, a control panel 40 (e.g., an operation board), a hard disc drive (HDD) 50, an engine control board 501, the ADF 201, an input/output (I/O) control board 510, a scanner board (SBU) 203, and a laser diode board (LDB) 520. The controller board 80 controls the entire image forming apparatus 1. The control panel 40 is coupled to the controller board 80 and disposed atop the image forming apparatus 1. The HDD 50 stores image data. The engine control board 501 is connected to the controller board 80 through a peripheral component interconnect (PCI) bus 103. The ADF 201 is coupled to the engine control board 501. The I/O control board 510 controls input and output of the image forming apparatus 1. The SBU 203 reads an image on an original. The LDB 520 optically writes an electrostatic latent image on the photoconductive drum according to image data.

The ADF 201 includes an original set sensor 202 that detects the original placed on an original table. The original set sensor 202 sends a detection result to the engine control board 501. The image scanner 200 configured to optically read the image on the original causes a light source to emit light that scans the original. A color charge-coupled device (CCD) 204, that is, a three-line color CCD, forms an image according to the light reflected by the original. The color CCD 204 performs photoelectric conversion to convert the light reflected by the original into a red (R) image signal, a green (G) image signal, and a blue (B) image signal which enter three analog application specific integrated circuits (ASIC) 205 of the SBU 203, respectively. The SBU 203 includes the analog ASICs 205, a charge-coupled device (CCD), and a timing generation-control circuit 206 that generates a driving time signal to drive the analog ASICs 205. Output of the color CCD 204 is treated with predetermined correction processing and is sent from an output interface (I/F) 207 to an image processing processor (IPP) 503 through an image data bus. The IPP 503 corrects a degraded signal. The corrected signal is sent to and written into a frame memory 81 of the controller board 80.

The controller board 80 includes a central processing unit (CPU) 82, a read-only memory (ROM) 83, a static random access memory (SRM) 84 (e.g., an SRAM), a non-volatile random access memory (NV-RAM) 85, an application specific integrated circuit (ASIC) 86, an interface circuit of the ASIC 86, and a working memory 87. The ROM 83 controls the controller board 80. The SRM 84 is a working memory used by the CPU 82. The NV-RAM 85 incorporates a lithium battery, a backup of the SRM 84, and a clock. The ASIC 86 controls a system bus of the controller board 80, the frame memory 81, and a periphery of the CPU 82 such as a first-in first-out (FIFO). The controller board 80 has a plurality of applications, such as a scanner application, a printer application, and a copier application, and controls the entire system. If the image forming apparatus 1 has a facsimile function, the controller board 80 has a facsimile application also. The controller board 80 decodes input from the control panel 40 and displays a setting of the system and a status of the setting on a display of the control panel 40.

The control panel 40 incorporates a central processing unit (CPU), a read-only memory (ROM), a random access memory (RAM), a liquid crystal display (LCD), and an application specific integrated circuit (ASIC), that is, a liquid crystal display controller (LCDC), which controls input by a user with keys. The ROM is written with a control program for the control panel 40 that controls reading of input and displaying of output. The RAM is a working memory used by the CPU. The control panel 40 includes an input portion with which the user inputs the setting of the system and the display which displays the setting of the system and the status of the setting. The control panel 40 communicates with the controller board 80.

The working memory 87 of the controller board 80 outputs writing signals for cyan, magenta, yellow, and black image data to writing circuits of laser diode boards (LDB) for cyan (C) image data, magenta (M) image data, yellow (Y) image data, and black (K) image data of the LDB 520, respectively. Each of the writing circuits performs an electric current control (e.g., a modulation control) for each laser diode and outputs a controlled electric current to each laser diode.

The engine control board 501 performs an image formation control mainly. The engine control board 501 includes a central processing unit (CPU) 502 that also performs a productivity control, the internet printing protocol (IPP) 503 that performs image processing, a read-only memory (ROM) 504 that incorporates a program used to control copying and printing, a static random access memory (SRM) 506 that controls the program, a non-volatile random access memory (NV-RAM) 505, and an input/output (I/O) application specific integrated circuit (ASIC) 507. The I/O ASIC 507 includes a serial interface that sends and receives a signal to and from the CPU 502 that performs other control. The I/O ASIC 507 controls proximal interfaces (e.g., a counter, a fan, a solenoid, and a motor) implemented with the engine control board 501. The I/O control board 510 is coupled to the engine control board 501 through a synchronous serial interface.

The I/O control board 510 includes a sub central processing unit (CPU) 511, an interface circuit 512, and input/output (I/O) application specific integrated circuits (ASIC) 513. The sub CPU 511 converts an output voltage Vco output by a fixing temperature sensor (e.g., the temperature sensor 29 depicted in FIG. 2) and a capacitor power supply and an analog signal output by a P sensor (e.g., a developer amount sensor), a T sensor (e.g., a toner density sensor), and the like into a digital signal and reads the digital signal. The I/O control board 510 performs driving of an output device, detection of jamming of the sheet 20 with a sheet sensor, and an input/output control of the image forming apparatus 1 including a sheet conveyance control. The interface circuit 512 is coupled to various sensors 530, a high voltage power supply 531, and a plurality of actuators, that is, a motor 532, a clutch 533, and a solenoid 534.

The CPU 502 sends a command to adjust an amount of power supply to a power supply unit (PSU) 540. The PSU 540 supplies power that controls the image forming apparatus 1. The PSU 540 includes a main power supply circuit that supplies a direct current voltage to each component of the image forming apparatus 1. When a main switch 541 of the image forming apparatus 1 is turned on or closed, a commercial power supply is connected to each component of the image forming apparatus 1. The commercial power supply supplies a commercial alternate current to an alternate current (AC) control circuit 542. The AC control circuit 542 supplies an alternate current to the heater 30 of the fixing device 22 depicted in FIG. 2.

Under the configuration of the electric system described below, a power supply to the heater 30 is turned on and off based on a temperature of the outer circumferential surface of the fixing roller 27 that is detected by the temperature sensor 29 so that the temperature of the outer circumferential surface of the fixing roller 27 reaches a target temperature (e.g., a preset temperature). The target temperature is various. For example, the target temperature is a fixing temperature during printing at which the toner image is fixed on the sheet 20, a standby temperature before printing starts, a standby temperature in an energy saver mode, or the like. According to this exemplary embodiment, the target temperature is the fixing temperature.

A description is provided of a configuration of a comparative fixing device.

The comparative fixing device includes a fixing rotator (e.g., a fixing roller and a fixing belt), a heater that heats the fixing rotator, and a pressure rotator (e.g., a pressure roller) pressed against the fixing rotator to form a fixing nip therebetween. The fixing rotator and the pressure rotator fix a toner image on a sheet under heat and pressure. The heater is requested to conduct an appropriate amount of heat to the fixing rotator so that the fixing rotator heats toner of the toner image on the sheet to fix the toner image on the sheet properly. While the sheet is conveyed through the fixing nip, the sheet draws heat from the fixing rotator, decreasing the temperature of an outer circumferential surface of the fixing rotator. To address this circumstance, the heater heats the fixing rotator. However, if the sheet is thick paper that draws heat more than plain paper and a power supply does not supply power to the heater that is great enough for the heater to allow the fixing rotator to heat the thick paper, the fixing rotator may suffer from shortage of heat. Accordingly, the fixing rotator may not attain a target temperature and may not melt toner of the toner image on the sheet, suffering from cold offset that prohibits the fixing rotator from fixing the toner image on the sheet. The fixing rotator is susceptible to cold offset when an image forming apparatus incorporating the comparative fixing device is powered on in the morning when the fixing rotator stores heat insufficiently.

To address this circumstance, if the fixing rotator does not attain a predetermined temperature (e.g., a threshold), sheets may be conveyed to the fixing nip with an extended interval between a preceding sheet and a subsequent sheet or the fixing rotator may rotate at a reduced linear velocity, thus degrading productivity of image formation, which is defined by the number of sheets printed per unit time (e.g., copies per minute) that varies depending on the type of sheets. Thus, an amount of heat drawn by the sheets per unit time is reduced.

Alternatively, power consumption may be restricted within a preset standard capacity of a power supply and power supplied to the heater may be corrected based on power consumed in the image forming apparatus so as to retain stable fixing without degrading productivity. As power consumption increases, power supply to the heater decreases. As a temperature of the outer circumferential surface of the fixing rotator decreases to a predetermined temperature, productivity decreases and a time period for which productivity decreases is adjusted based on a decreased amount of power supplied to the heater.

However, if an ambient temperature of the image forming apparatus is relatively low, if the heater suffers from shortage of power, or if the fixing rotator stores heat insufficiently, the temperature of the fixing rotator may decrease sharply. In this case, even if productivity decreases after the temperature of the fixing rotator decreases, heat may not conduct to the fixing rotator in time and the temperature of the fixing rotator may decrease excessively, resulting in faulty fixing.

To address those circumstances of the comparative fixing device, the image forming apparatus 1 according to this exemplary embodiment performs a primary productivity control and a secondary productivity control simultaneously. The primary productivity control is performed based on a temperature of the fixing roller 27 serving as a fixing rotator, which is detected by the temperature sensor 29. The secondary productivity control is performed based on an amount of power suppliable to the heater 30.

Figure 4:
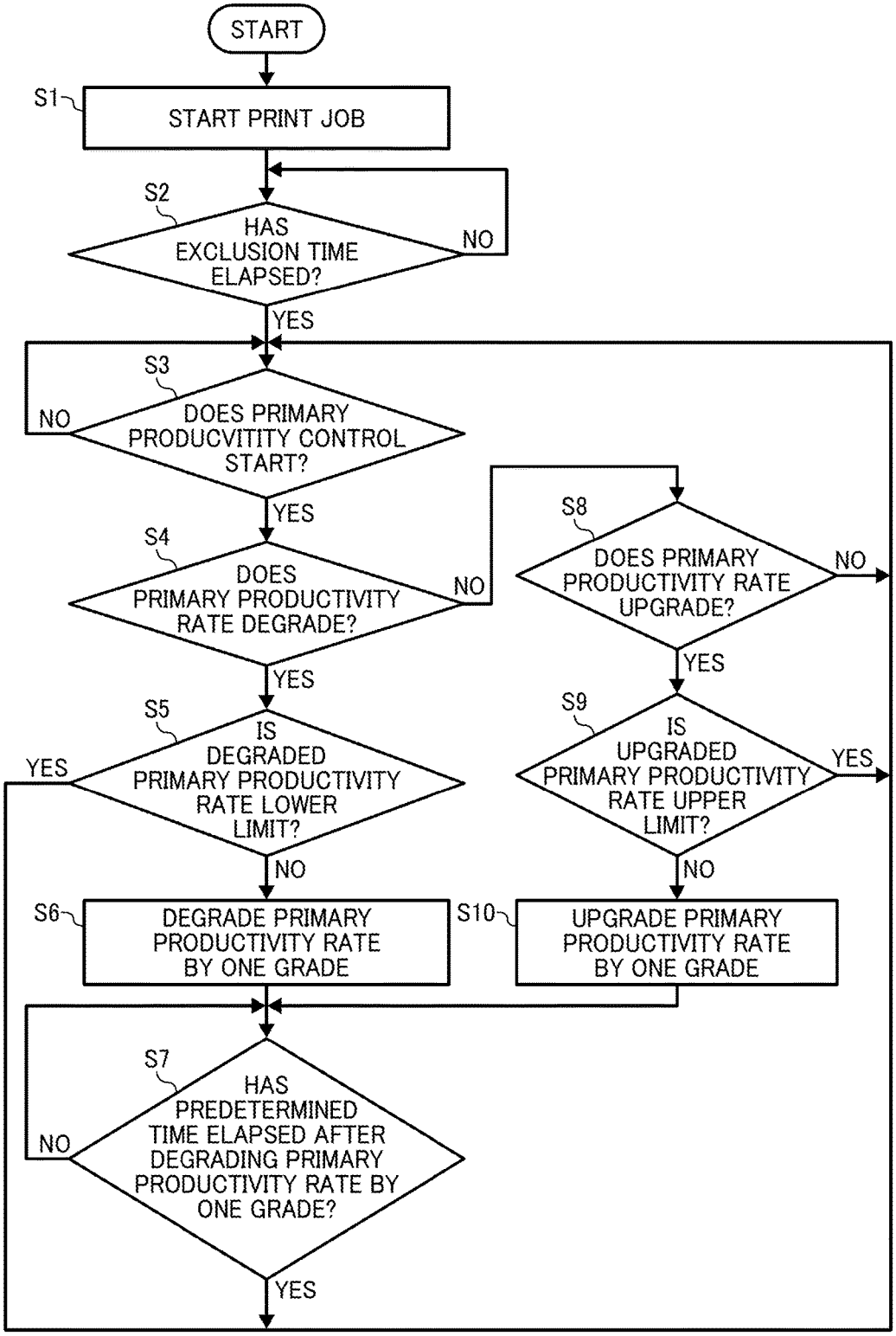
FIG. 4 is a flowchart illustrating control processes of a primary productivity control performed by the image forming apparatus depicted in FIG. 3.

Referring to FIG. 4, a description is provided of the primary productivity control.

FIG. 4 is a flowchart illustrating control processes of the primary productivity control. In step S1, a print job starts, that is, conveyance of a sheet 20 starts. In step S2, a controller (e.g., the I/O control board 510 depicted in FIG. 3) determines whether or not an exclusion time T1 (e.g., a predetermined time) has elapsed after the print job starts. If the controller determines that the exclusion time T1 has elapsed (YES in step S2), the controller determines whether or not to start the primary productivity control in step S3.

The exclusion time T1 defines a time for which productivity is maintained after the fixing roller 27 is heated to a target fixing temperature Tt at which a productivity rate of 100 percent is attained. The exclusion time T1 is predetermined according to the type of the sheet 20. If the controller determines to start the primary productivity control (YES in step S3), the controller determines whether or not to degrade a primary productivity rate in step S4. The controller determines to degrade the primary productivity rate when a formula (1) below is satisfied.

$$Tt-Ta>\Delta Td \quad (1)$$

In the formula (1), Tt represents the target fixing temperature of the fixing roller 27 while the sheet 20 is conveyed through the fixing device 22. Ta represents a detected temperature of the fixing roller 27 that is detected by the temperature sensor 29. ΔTd represents a degradation threshold to determine to degrade the primary productivity rate. When a difference between the target fixing temperature Tt and the detected temperature Ta is greater than the degradation threshold ΔTd, the controller degrades the primary productivity rate. If the controller determines to degrade the primary productivity rate (YES in step S4), the controller determines whether or not the degraded primary productivity rate is a lower limit in step S5. If the controller determines that the degraded primary productivity rate is not the lower limit (NO in step S5), the controller degrades the primary productivity rate by one grade in step S6. The primary productivity rate defines the number of sheets 20 printed per unit time, which varies depending on the type of the sheet 20, that is, a predetermined process linear velocity of the sheet 20. The degraded primary productivity rate defines a rate with which the controller degrades productivity of image formation by increasing an interval between the sheets 20 conveyed through the fixing device 22 or decreasing the linear velocity of the fixing roller 27 rotating in the rotation direction D27. The degraded primary productivity rate is available in three grades, for example, 80 percent, 65 percent, and 50 percent.

In step S7, the controller determines whether or not a predetermined time has elapsed after the controller degrades the primary productivity rate by one grade. If the controller determines that the predetermined time has elapsed (YES in step S7), the controller determines again whether or not to start the primary productivity control in step S3. Whenever the controller determines to degrade the primary productivity rate (YES in step S4), the controller degrades the primary productivity rate by one grade as long as the controller determines that the degraded primary productivity rate is not the lower limit in step S5. According to this exemplary embodiment, the lower limit of the degraded primary productivity rate is 50 percent.

If the controller determines not to degrade the primary productivity rate (NO in step S4), the controller determines whether or not to upgrade the primary productivity rate in step S8. The controller determines to upgrade the primary productivity rate when a formula (2) below is satisfied.

$$Tt-Ta<\Delta Tu \quad (2)$$

In the formula (2), ΔTu represents an upgradation threshold to determine to upgrade the primary productivity rate, that is, a difference between the target fixing temperature Tt and the detected temperature Ta. If the controller determines to upgrade the primary productivity rate (YES in step S8), the controller determines whether or not the upgraded primary productivity rate is an upper limit in step S9. If the controller determines that the upgraded primary productivity rate is not the upper limit (NO in step S9), that is, if the controller determines that the upgraded primary productivity rate is not 100 percent, the controller upgrades the primary productivity rate by one grade in step S10. That is, the controller resets the degraded primary productivity rate by one grade. In step S7, the controller determines whether or not the predetermined time has elapsed after the controller resets the degraded primary productivity rate by one grade. If the controller determines that the predetermined time has elapsed (YES in step S7), the controller determines again whether or not to start the primary productivity control in step S3.

Figure 5:
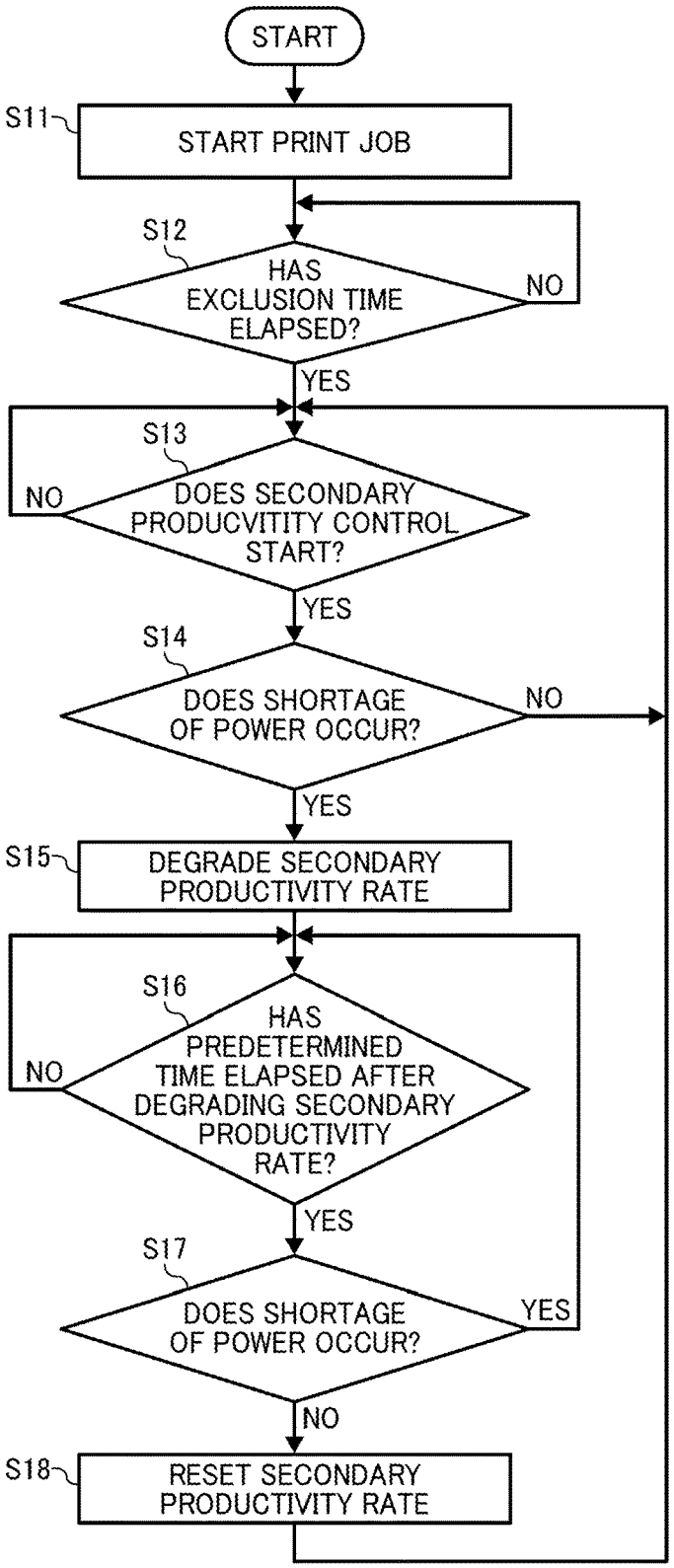
FIG. 5 is a flowchart illustrating control processes of a secondary productivity control performed by the image forming apparatus depicted in FIG. 3.

Referring to FIG. 5, a description is provided of the secondary productivity control.

FIG. 5 is a flowchart illustrating control processes of the secondary productivity control. A total power consumed to drive each component of the image forming apparatus 1 fully may exceed a maximum power of 1,500 W suppliable from a commercial power supply located in an office. To address this circumstance, a table stores data about a maximum power consumed to drive each section of the image forming apparatus 1, that is, a reading section including the image scanner 200 incorporating a motor and an illumination lamp, an image forming section including the image forming devices 12*c*, 12*m*, 12*y*, and 12*k*, and a sheet conveying section including the feed roller 17, the conveyance roller pair 19, and the output device 23. When the controller identifies shortage of power, the controller subtracts the total power consumed by the image forming apparatus 1 from the maximum power of 1,500 W, for example, thus calculating a power P suppliable to the heater 30 of the fixing device 22. Alternatively, the controller may directly monitor an amount of power supplied from the power supply to the image forming apparatus 1.

In step S11, a print job starts, that is, conveyance of a sheet 20 starts. In step S12, the controller determines whether or not an exclusion time T2 has elapsed after the print job starts. The exclusion time T2 is different from the exclusion time T1 used in step S2 under the primary productivity control depicted in FIG. 4. If the controller determines that the exclusion time T2 has elapsed (YES in step S12), the controller determines whether or not to start the secondary productivity control in step S13. The exclusion time T2 secures a secondary productivity rate of a minor print job that forms the toner image on relatively few sheets 20. The controller is not requested to degrade the secondary productivity rate for the minor print job. The exclusion time T2 is preset by predetermining a time for which degradation in the secondary productivity rate is not requested in the minor print job. Alternatively, a plurality of exclusion times T2 is preset and selectively applied according to the type of the sheet 20. If the controller determines to start the secondary productivity control (YES in step S13), the controller determines whether or not shortage of power occurs in step S14. The controller determines that shortage of power occurs when a formula (3) below is satisfied.

$$P<Pj \quad (3)$$

In the formula (3), P represents an amount of power suppliable to the heater 30. Pj represents a power shortage threshold to identify shortage of power. The power shortage threshold Pj represents a power rating of the heater 30. If the controller determines that shortage of power occurs (YES in step S14), that is, if the controller determines that the formula (3) is satisfied, the controller degrades the secondary productivity rate in step S15. The amount of power P suppliable to the heater 30 varies depending on peripherals connected to the image forming apparatus 1, an image forming condition, and actuation of the ADF 201 and the like. In step S16, the controller determines whether or not a predetermined time has elapsed after the controller degrades the secondary productivity rate in step S15. If the controller determines that the predetermined time has elapsed (YES in step S16), the controller determines again whether or not shortage of power occurs in step S17. If the controller determines that shortage of power does not occur (NO in step S17), the controller resets the secondary productivity rate in step S18. For example, the controller determines that shortage of power does not occur when the amount of power P suppliable to the heater 30 increases to a level above the power rating of the heater 30 as actuation of the ADF 201 is finished. The degraded secondary productivity rate under the secondary productivity control is determined based on the ambient temperature and the type of the sheet 20.

Figures 6, 7:
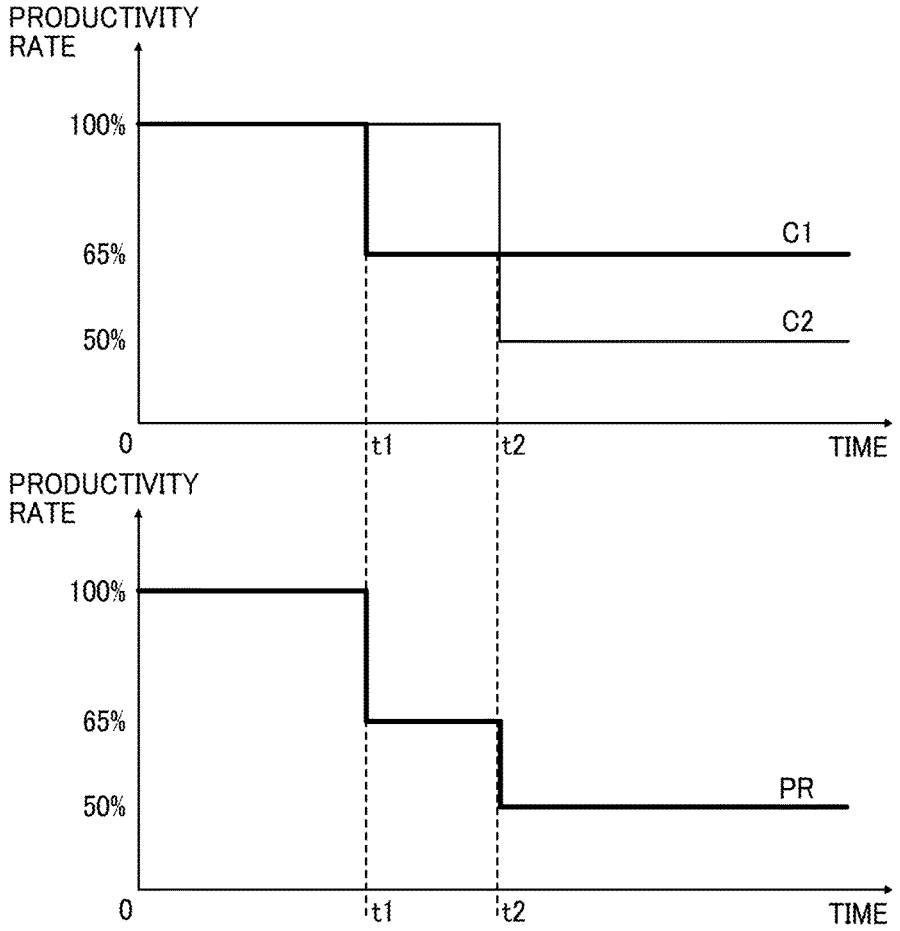
FIG. 6 is a matrix illustrating a degraded secondary productivity rate under the secondary productivity control depicted in FIG. 5, which varies depending on an ambient temperature and a type of a sheet conveyed through the fixing device depicted in FIG. 2.
FIG. 7 is a graph illustrating a relation between time and a primary productivity rate selected under the primary productivity control depicted in FIG. 4 and a secondary productivity rate selected under the secondary productivity control depicted in FIG. 5 and a relation between time and a productivity rate of the image forming apparatus depicted in FIG. 1.

As one example, FIG. 6 illustrates a matrix of the secondary productivity rate, including the degraded secondary productivity rate, which varies depending on the ambient temperature and the type of the sheet 20. The image forming apparatus 1 according to this exemplary embodiment may supply power of 100 percent to the fixing device 22 to fix the toner image on plain paper if the ambient temperature is not lower than 23 degrees centigrade that is higher than a standard room temperature, even if a device other than the fixing device 22 such as the ADF 201 is actuated. Even if the fixing device 22 is installed in the image forming apparatus 1, when the ambient temperature of the image forming apparatus 1 is relatively low or thick paper is used as the sheet 20, the temperature of the outer circumferential surface of the fixing roller 27 is susceptible to sharp decrease, resulting in substantial degradation in productivity.

The controller performs the primary productivity control simultaneously with and separately from the secondary productivity control. The controller selects one of the primary productivity rate and the secondary productivity rate whichever is lower as a productivity rate of the image forming apparatus 1. FIG. 7 is a graph illustrating a relation between time and a productivity rate, that is, a degraded primary productivity rate selected under the primary productivity control and a degraded secondary productivity rate selected under the secondary productivity control and a relation between time and a productivity rate of the image forming apparatus 1. In FIG. 7, C1 represents a primary productivity rate under the primary productivity control, C2 represents a secondary productivity rate under the secondary productivity control, and PR represents a productivity rate of the image forming apparatus 1, that is, a machine productivity rate.

Until a time t1, the controller selects the primary productivity rate C1 and the secondary productivity rate C2 of 100 percent under the primary productivity control and the secondary productivity control, respectively. Thus, the productivity rate PR of the image forming apparatus 1 is 100 percent.

From the time t1 to a time t2, the controller selects the degraded primary productivity rate C1 of 65 percent under the primary productivity control, which is lower than the secondary productivity rate C2 of 100 percent selected under the secondary productivity control. Thus, the productivity rate PR of the image forming apparatus 1 is 65 percent.

After the time t2, the controller selects the degraded secondary productivity rate C2 of 50 percent under the secondary productivity control, which is lower than the degraded primary productivity rate C1 of 65 percent selected under the primary productivity control. Thus, the productivity rate PR of the image forming apparatus 1 is 50 percent.

As described above, in addition to the primary productivity control performed based on the temperature of the fixing roller 27 that is detected by the temperature sensor 29, the controller performs the secondary productivity control based on the amount of power suppliable to the heater 30 to address a circumstance in which the temperature of the fixing roller 27 decreases sharply. Accordingly, the fixing device 22 is immune from fixing failure caused by an environment of the image forming apparatus 1 and a condition in which the sheet 20 is conveyed.

A description is provided of a tertiary productivity control according to another exemplary embodiment of the image forming apparatus 1.

The image forming apparatus 1 performs the tertiary productivity control in addition to the primary productivity control performed based on the temperature of the outer circumferential surface of the fixing roller 27 that is detected by the temperature sensor 29 and the secondary productivity control performed based on the amount of power suppliable to the heater 30. The tertiary productivity control is performed based on an amount of heat stored by the fixing roller 27 simultaneously with the primary productivity control and the secondary productivity control. Since the primary productivity control and the secondary productivity control are described with reference to the flowcharts illustrated in FIGS. 4 and 5, respectively, a description of the primary productivity control and the secondary productivity control performed by the image forming apparatus 1 according to this exemplary embodiment is omitted.

Figure 8:
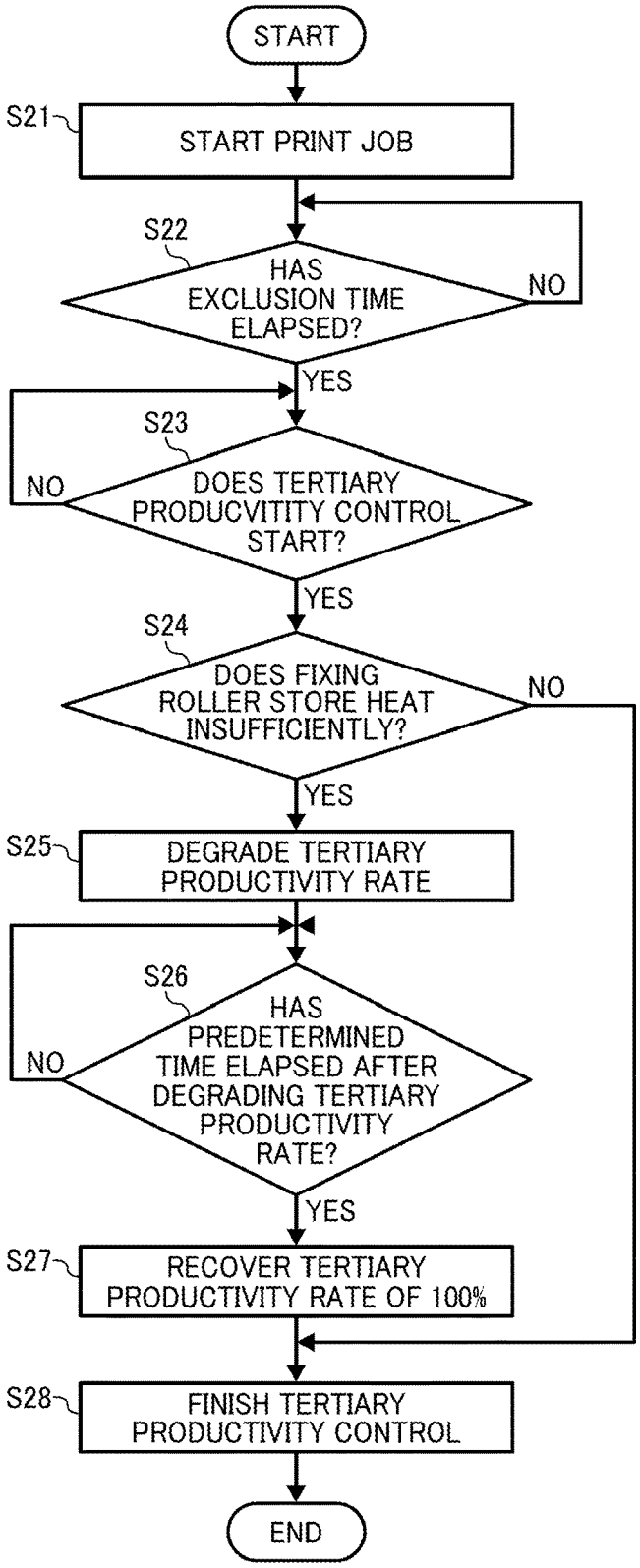
FIG. 8 is a flowchart illustrating control processes of a tertiary productivity control performed by the image forming apparatus depicted in FIG. 3.

FIG. 8 is a flowchart illustrating control processes of the tertiary productivity control. In step S21, a print job starts, that is, conveyance of a sheet 20 starts. In step S22, the controller determines whether or not an exclusion time T3 has elapsed after the print job starts. The exclusion time T3 is different from the exclusion time T1 used in step S2 under the primary productivity control depicted in FIG. 4 and the exclusion time T2 used in step S12 under the secondary productivity control depicted in FIG. 5. If the controller determines that the exclusion time T3 has elapsed (YES in step S22), the controller determines whether or not to start the tertiary productivity control in step S23. The exclusion time T3 defines a time for which a tertiary productivity rate is maintained even if the sheet 20 draws heat from the fixing roller 27 when the ambient temperature is a standard room temperature. The exclusion time T3 is predetermined according to the type of the sheet 20. If the controller determines to start the tertiary productivity control (YES in step S23), the controller determines whether or not the fixing roller 27 stores heat insufficiently in step S24. For example, the controller determines whether or not the fixing roller 27 stores a sufficient amount of heat based on a temperature of a cored bar 27*a* of the fixing roller 27.

Figure 9:
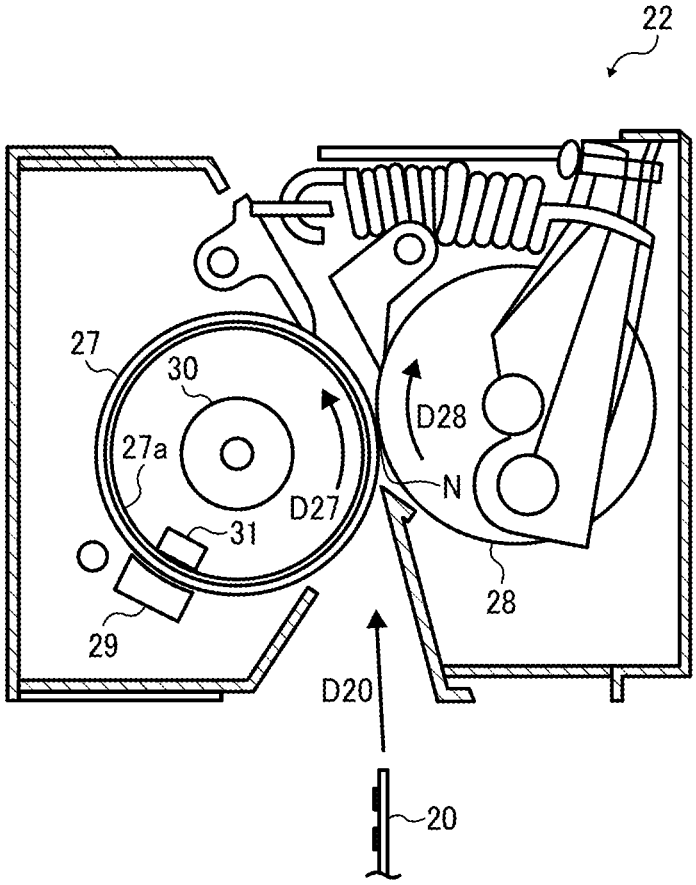
FIG. 9 is a cross-sectional view of the fixing device depicted in FIG. 2 at an axial end of a fixing roller in an axial direction thereof.

FIG. 9 is a cross-sectional view of the fixing device 22 at an axial end of the fixing roller 27 in an axial direction thereof. As illustrated in FIG. 9, the fixing roller 27 includes the cored bar 27*a*. The fixing device 22 includes a temperature sensor 31 in addition to the temperature sensor 29 that detects the temperature of the outer circumferential surface of the fixing roller 27. The temperature sensor 31 is disposed opposite a lateral end of the cored bar 27*a* in the axial direction of the fixing roller 27 and detects the temperature of the cored bar 27*a*.

The controller determines that the fixing roller 27 stores heat insufficiently when a formula (4) below is satisfied.

$$T<Tj \quad (4)$$

In the formula (4), T represents a temperature of the cored bar 27*a* of the fixing roller 27 that is detected by the temperature sensor 31 when the tertiary productivity control starts. Tj represents a heat storage threshold to determine that the fixing roller 27 stores heat insufficiently, for example, the fixing roller 27 is not heated to the target fixing temperature. If the controller determines that the fixing roller 27 stores heat insufficiently (YES in step S24), the controller degrades the tertiary productivity rate to 80 percent, for example, in step S25. If the controller determines that the temperature T is not lower than the heat storage threshold Tj, the controller determines that the fixing roller 27 stores heat sufficiently. Accordingly, the controller does not degrade the tertiary productivity rate and finishes the tertiary productivity control. The controller degrades the tertiary productivity rate for a predetermined degradation time Tc. In step S26, the controller determines whether or not the degradation time Tc has elapsed after the controller starts degrading the tertiary productivity rate. If the controller determines that the degradation time Tc has elapsed (YES in step S26), the controller recovers the tertiary productivity rate of 100 percent in step S27. In step S28, the controller finishes the tertiary productivity control. The degraded tertiary productivity rate in the tertiary productivity control is determined based on the type of the sheet 20. Like the secondary productivity rate, the tertiary productivity rate degrades as the thickness of the sheet 20 increases. That is, the thicker the sheet 20 is, the lower the tertiary productivity rate is.

Figure 10:
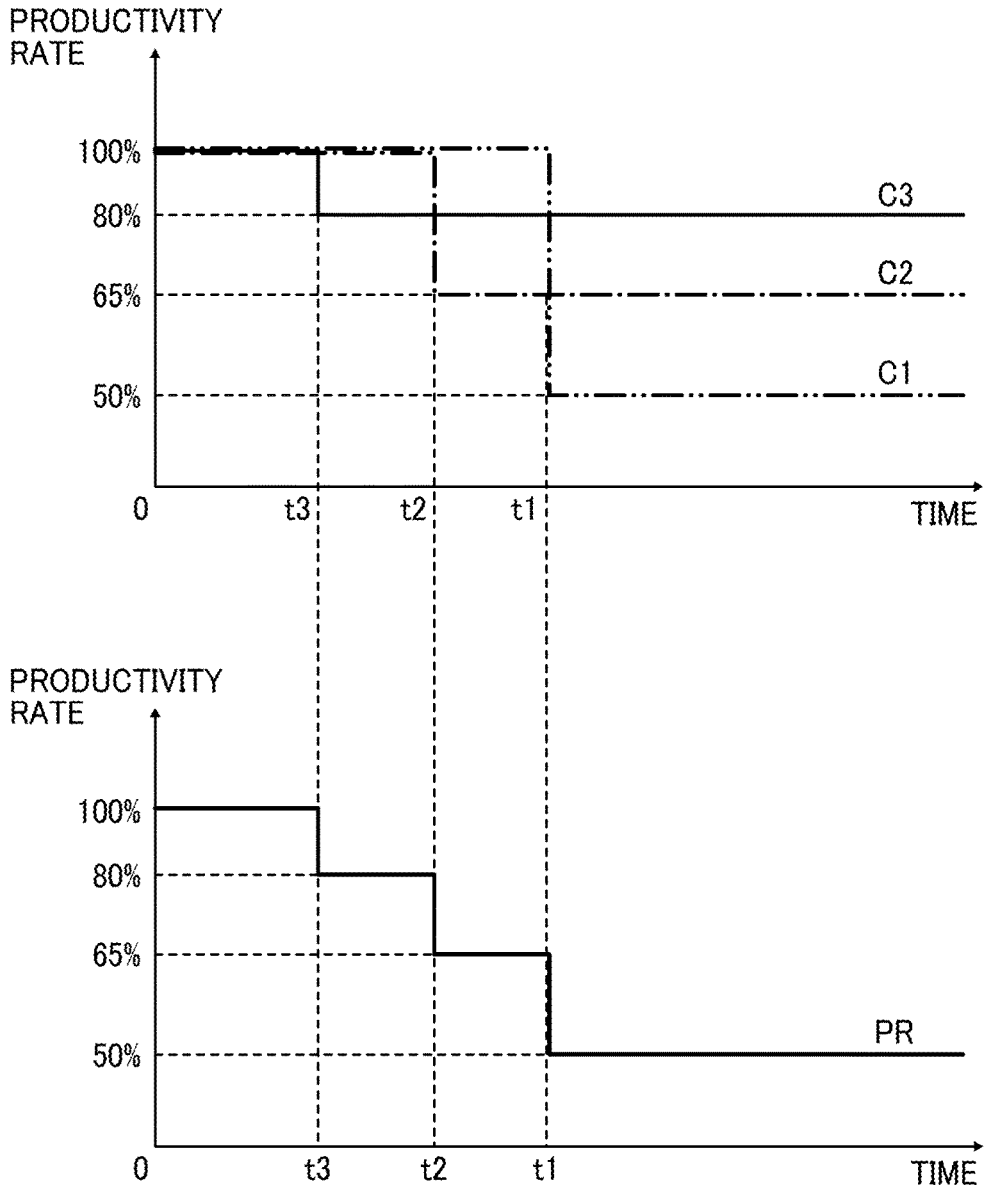
FIG. 10 is a graph illustrating a relation between time and the primary productivity rate selected under the primary productivity control depicted in FIG. 4, the secondary productivity rate selected under the secondary productivity control depicted in FIG. 5, and a tertiary productivity rate selected under the tertiary productivity control depicted in FIG. 8 and a relation between time and the productivity rate of the image forming apparatus depicted in FIG. 1.

The controller performs the primary productivity control, the secondary productivity control, and the tertiary productivity control simultaneously and separately from each other. The controller selects one of the primary productivity rate, the secondary productivity rate, and the tertiary productivity rate whichever is lowest as a productivity rate of the image forming apparatus 1. FIG. 10 is a graph illustrating a relation between time and a productivity rate, that is, the primary productivity rate selected under the primary productivity control, the secondary productivity rate selected under the secondary productivity control, and the tertiary productivity rate selected under the tertiary productivity control and a relation between time and the productivity rate of the image forming apparatus 1. In FIG. 10, C1 represents the primary productivity rate under the primary productivity control, C2 represents the secondary productivity rate under the secondary productivity control, C3 represents a tertiary productivity rate under the tertiary productivity control, and PR represents the productivity rate of the image forming apparatus 1.

Until a time t3, the controller selects the primary productivity rate C1 of 100 percent under the primary productivity control, the secondary productivity rate C2 of 100 percent under the secondary productivity control, and the tertiary productivity rate C3 of 100 percent under the tertiary productivity control. Thus, the productivity rate PR of the image forming apparatus 1 is 100 percent.

From the time t3 to the time t2, the controller selects the degraded tertiary productivity rate C3 of 80 percent under the tertiary productivity control, which is lower than the primary productivity rate C1 of 100 percent selected under the primary productivity control and the secondary productivity rate C2 of 100 percent selected under the secondary productivity control. Thus, the productivity rate PR of the image forming apparatus 1 is 80 percent.

From the time t2 to the time t1, the controller selects the degraded secondary productivity rate C2 of 65 percent under the secondary productivity control, which is lower than the primary productivity rate C1 of 100 percent selected under the primary productivity control and the degraded tertiary productivity rate C3 of 80 percent selected under the tertiary productivity control. Thus, the productivity rate PR of the image forming apparatus 1 is 65 percent.

After the time t1, the controller selects the degraded primary productivity rate C1 of 50 percent under the primary productivity control, which is lower than the degraded tertiary productivity rate C3 of 80 percent selected under the tertiary productivity control and the degraded secondary productivity rate C2 of 65 percent selected under the secondary productivity control. Thus, the productivity rate PR of the image forming apparatus 1 is 50 percent.

As described above, in addition to the primary productivity control performed based on the temperature of the fixing roller 27 that is detected by the temperature sensor 29, the controller performs the secondary productivity control based on the amount of power suppliable to the heater 30 and the tertiary productivity control based on the amount of heat stored by the fixing roller 27 to address the circumstance in which the temperature of the fixing roller 27 decreases sharply. Accordingly, the fixing device 22 is immune from fixing failure caused by an environment of the image forming apparatus 1 and a condition in which the sheet 20 is conveyed.

A description is provided of advantages of the fixing device 22.

As illustrated in FIGS. 1 and 3, an image forming apparatus (e.g., the image forming apparatus 1) includes a fixing device (e.g., the fixing device 22) and a controller (e.g., the I/O control board 510). As illustrated in FIG. 2, the fixing device includes a fixing rotator (e.g., the fixing roller 27), a heater (e.g., the heater 30), and a temperature detector (e.g., the temperature sensor 29). The fixing rotator is rotatable in a predetermined direction of rotation (e.g., the rotation direction D27). The heater is disposed opposite the fixing rotator and heats the fixing rotator. The temperature detector is disposed opposite the fixing rotator and detects a temperature of the fixing rotator.

As illustrated in FIG. 4, when a predetermined time (e.g., the exclusion time T1) elapses after conveyance of a recording medium (e.g., a sheet 20) starts, the controller performs a primary productivity control to define a primary productivity rate of image formation, that is, printing per unit time, based on the temperature of the fixing rotator which is detected by the temperature detector. The controller includes a power calculator that calculates an amount of power suppliable to the heater. The controller performs a secondary productivity control to define a secondary productivity rate of image formation, that is, printing per unit time, based on the amount of power suppliable to the heater. The controller performs the primary productivity control simultaneously with and separately from the secondary productivity control. The controller selects one of the primary productivity rate and the secondary productivity rate whichever is lower as a productivity rate of the image forming apparatus.

In addition to the primary productivity control performed based on the temperature of the fixing rotator that is detected by the temperature detector, the controller performs the secondary productivity control based on the amount of power suppliable to the heater that is determined based on an amount of power consumed by the image forming apparatus. The controller performs the primary productivity control simultaneously with and separately from the secondary productivity control. The controller selects one of the primary productivity rate and the secondary productivity rate whichever is lower as the productivity rate of the image forming apparatus. Accordingly, even if the temperature of the fixing rotator decreases sharply, the fixing device is immune from fixing failure and retains an appropriate productivity.

According to the exemplary embodiments described above, the fixing roller 27 serves as a fixing rotator. Alternatively, a fixing belt, a fixing film, a fixing sleeve, or the like may be used as a fixing rotator. Further, the pressure roller 28 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

What is claimed is:

1. An image forming apparatus comprising:

a fixing rotator configured to be rotated in a direction of rotation, such that a recording medium is conveyed over the fixing rotator;

a heater configured to heat the fixing rotator;

a temperature detector configured to detect a temperature of the fixing rotator; and a controller configured to perform a primary productivity control, the primary productivity control to define a primary productivity rate of printing per unit time based on the temperature of the fixing rotator that is detected by the temperature detector, calculate an amount of power suppliable to the heater and perform a secondary productivity control simultaneously with and separately from the primary productivity control, the secondary productivity control to define a secondary productivity rate of printing per unit time based on the amount of power suppliable to the heater, and select a lower productivity rate of the primary productivity rate and the secondary productivity rate as a productivity rate of the image forming apparatus.

2. The image forming apparatus according to claim 1, wherein the controller is configured to degrade the primary productivity rate under the primary productivity control in response to a determination that a difference between a target temperature and the temperature of the fixing rotator that is detected by the temperature detector is greater than a degradation threshold.

3. The image forming apparatus according to claim 2, wherein the controller is configured to upgrade the primary productivity rate under the primary productivity control in response to a determination that the difference between the target temperature and the temperature of the fixing rotator that is detected by the temperature detector is smaller than an upgradation threshold.

4. The image forming apparatus according to claim 1, wherein the controller is configured to degrade the secondary productivity rate under the secondary productivity control in response to a determination that the amount of power suppliable to the heater is smaller than a power shortage threshold.

5. The image forming apparatus according to claim 4, wherein the power shortage threshold is a power rating of the heater.

6. The image forming apparatus according to claim 4, wherein the controller is configured to define the secondary productivity rate under the secondary productivity control based on an ambient temperature and a type of the recording medium.

7. The image forming apparatus according to claim 1, wherein the controller is configured to perform a tertiary productivity control simultaneously with and separately from the primary productivity control and the secondary productivity control, the tertiary productivity control to define a tertiary productivity rate of printing per unit time based on an amount of heat stored by the fixing rotator, and select a lowest productivity rate of the primary productivity rate, the secondary productivity rate, and the tertiary productivity rate as the productivity rate of the image forming apparatus.

8. The image forming apparatus according to claim 7, wherein the fixing rotator includes a cored bar.

9. The image forming apparatus according to claim 8, further comprising another temperature detector, the another temperature detector configured to detect a temperature of the cored bar.

10. The image forming apparatus according to claim 9, wherein the controller is configured to define the amount of heat stored by the fixing rotator based on the temperature of the cored bar that is detected by the another temperature detector.

11. The image forming apparatus according to claim 10, wherein the controller is configured to degrade the tertiary productivity rate in response to a determination that the temperature of the cored bar that is detected by the another temperature detector is smaller than a heat storage threshold.

12. The image forming apparatus according to claim 11, wherein the controller is configured to define the heat storage threshold based on an ambient temperature and a type of the recording medium.

13. The image forming apparatus according to claim 7, wherein the controller is configured to perform at least one of the primary productivity control, the secondary productivity control, and the tertiary productivity control in response to a determination that an exclusion time elapses after conveyance of the recording medium starts.

14. The image forming apparatus according to claim 13, wherein the exclusion time varies depending on the primary productivity control, the secondary productivity control, and the tertiary productivity control.

15. The image forming apparatus according to claim 1, wherein the temperature detector includes a temperature sensor disposed opposite an outer circumferential surface of the fixing rotator.

16. The image forming apparatus according to claim 1, wherein the fixing rotator includes a fixing roller.

17. An image forming apparatus comprising:

a fixing rotator configured to be rotated in a direction of rotation, such that a recording medium is conveyed over the fixing rotator;

a heater configured to heat the fixing rotator;

a temperature detector configured to detect a temperature of the fixing rotator; and a controller configured to perform a primary productivity control, the primary productivity control to define a primary productivity rate of printing per unit time based on the temperature of the fixing rotator that is detected by the temperature detector, calculate an amount of power suppliable to the heater and perform a secondary productivity control simultaneously with and separately from the primary productivity control, the secondary productivity control to define a secondary productivity rate of printing per unit time based on the amount of power suppliable to the heater, select a lower productivity rate of the primary productivity rate and the secondary productivity rate as a productivity rate of the image forming apparatus, perform a tertiary productivity control simultaneously with and separately from the primary productivity control and the secondary productivity control, the tertiary productivity control to define a tertiary productivity rate of printing per unit time based on an amount of heat stored by the fixing rotator, and select a lowest productivity rate of the primary productivity rate, the secondary productivity rate, and the tertiary productivity rate as the productivity rate of the image forming apparatus.

18. The image forming apparatus according to claim 17, wherein the fixing rotator includes a cored bar.

19. The image forming apparatus according to claim 18, further comprising:

another temperature detector, the another temperature detector configured to detect a temperature of the cored bar.

20. The image forming apparatus according to claim 19, wherein the controller is configured to define the amount of heat stored by the fixing rotator based on the temperature of the cored bar that is detected by the another temperature detector.

21. The image forming apparatus according to claim 20, wherein the controller is configured to degrade the tertiary productivity rate in response to a determination that the temperature of the cored bar that is detected by the another temperature detector is smaller than a heat storage threshold.

22. The image forming apparatus according to claim 21, wherein the controller is configured to define the heat storage threshold based on an ambient temperature and a type of the recording medium.

23. The image forming apparatus according to claim 17, wherein the controller is configured to perform at least one of the primary productivity control, the secondary productivity control, and the tertiary productivity control in response to a determination that an exclusion time elapses after conveyance of the recording medium starts.

24. The image forming apparatus according to claim 23, wherein the exclusion time varies depending on the primary productivity control, the secondary productivity control, and the tertiary productivity control.

* * * * *